US007586263B2

(12) United States Patent
Morimoto et al.

(10) Patent No.: US 7,586,263 B2
(45) Date of Patent: Sep. 8, 2009

(54) DISCHARGE LAMP HAVING A CATHODE AND EMITTER ASSEMBLY COMPOSED OF TUNGSTEN AND THORIUM OXIDE AND JOINED THROUGH A CARBIDE INTERFACE REGION

(75) Inventors: Shunichi Morimoto, Himeji (JP); Norihiro Inaoka, Himeji (JP); Yasuro Kikuchi, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 332 days.

(21) Appl. No.: 11/693,321

(22) Filed: Mar. 29, 2007

(65) Prior Publication Data

US 2007/0228982 A1 Oct. 4, 2007

(30) Foreign Application Priority Data

Mar. 29, 2006 (JP) ..... 2006-091255

(51) Int. Cl.

| | |
|---|---|
| ***H01J 61/073*** | (2006.01) |
| ***H01J 17/04*** | (2006.01) |
| *H01J 61/06* | (2006.01) |
| *H01J 1/144* | (2006.01) |

(52) U.S. Cl. ..... 313/633; 313/575; 313/491

(58) Field of Classification Search ..... 313/491, 313/574–575, 631–633, 311
See application file for complete search history.

(56) References Cited

U.S. PATENT DOCUMENTS

| | | | | |
|---|---|---|---|---|
| 3,619,699 | A * | 11/1971 | White | 313/628 |
| 6,215,247 | B1 * | 4/2001 | Kurano et al. | 313/631 |
| 2005/0099121 | A1 | 5/2005 | Kikuchi et al. | |

FOREIGN PATENT DOCUMENTS

JP 10-283921 A 10/1998

* cited by examiner

*Primary Examiner*—Mariceli Santiago
(74) *Attorney, Agent, or Firm*—David S. Safran; Roberts Mlotkowski Safran & Cole, P.C.

(57) ABSTRACT

A high pressure discharge lamp, in which an anode and a cathode are disposed opposite each other in a bulb, achieves a long service life due to thorium (Th) being stably supplied to the cathode tip for a long time after lamp operation has been commence since the formation of the flicker phenomenon is suppressed over a long time due to the cathode being made of tungsten which contains thorium oxide on a surface space from the cathode tip, a carbide layer of tungsten carbide is formed and the cathode being bordered by an emitter containing body of tungsten which contains thorium dioxide, and a carbide layer of tungsten carbide being formed at least in a region bordering the cathode.

5 Claims, 7 Drawing Sheets

DISCHARGE LAMP HAVING A CATHODE AND EMITTER ASSEMBLY COMPOSED OF TUNGSTEN AND THORIUM OXIDE AND JOINED THROUGH A CARBIDE INTERFACE REGION

BACKGROUND OF THE INVENTION

1. Field of the Invention

The invention relates to a high pressure discharge lamp filled with xenon gas as the emitter, which is used as a light source, for example, in a projection apparatus or the like using DLP® (digital light processing) technology.

2. Description of Related Art

Conventionally, a high pressure discharge lamp is one with the arrangement shown, for example, in FIG. 8. This high pressure discharge lamp 10 consists of a bulb of silica glass which has an arc tube 11, and sealing parts 12, with a cathode 19 and an anode 14 arranged opposite each other in the arc tube 11.

Furthermore, tungsten electrode rods 191, 141, which support the cathode 19 and anode 14, respectively, are inserted into a silica glass cylindrical retaining body 16, and thus, retained. Each retaining body 16 is permanently located in a respective one of the sealing parts 12 which has an axial through opening through which the electrode rod extends in the axial direction. Moreover, the electrode rods are sealed in the sealing part 12 by graded glass 15. The electrode rods 191, 141 extend outward from the outer end of the bulb and act as outer lead pins which supply power to the cathode 19 and the anode 14. The arc tube 11 is filled with xenon gas.

In a high pressure discharge lamp 10 with the above described arrangement, as is shown in FIG. 9, the cathode 19 is formed of a cylindrical body 192 and a truncated cone-shaped conical part 194 which is located on an end of the body 192 in one piece with it. Furthermore, the diameter is gradually reduced along the cathode axis L in the tip-shaped area 196 (to the left in FIG. 9) and a round, flat tip surface 193 is formed on its tip.

In such a discharge lamp, in order to obtain stable radiant light over a long time, an arc discharge which forms between the electrodes must be stabilized over a long time. For the cathode 19, thoriated tungsten is used in which an emissive material of thorium dioxide ($ThO_2$) is provided. A carbide layer A of tungsten carbide ($W_2C$) is formed on the surface of the base side region 195, which is a region outside of the tip-shaped area 196. This technology is described in JP-A-HEI 10-283921. FIG. 9 is a top view of the cathode in which the carbide layer A is advantageously shown using a broken line.

In this carbide layer A, during the arc discharge, the oxygen of the thorium dioxide ($ThO_2$) is trapped by the tungsten carbide ($W_2C$) and thorium (Th) is supplied with high efficiency to the tip surface 193 of the cathode 19. This thorium feed phenomenon occurs optimally at a temperature of 1400° C. to 1800° C. of the carbide layer A of tungsten carbide ($W_2C$) and is described by the following chemical formulas (formulas 1 and 2).

$$ThO_2+W_2C \rightarrow Th+2W+CO_2 \quad \text{(formula 1)}$$

$$ThO_2+2W_2C \rightarrow Th+4W+2CO \quad \text{(formula 2)}$$

The thorium feed phenomenon is further described below. The carbide layer formed on the cathode surface does not penetrate only through the cathode surface, but reaches into the interior of the cathode to a depth of roughly 100 μm from the cathode surface. The reactions described above using formulas 1 and 2, therefore, occur not only on the cathode surface, but also within the cathode. The thorium (Th) which forms within the cathode passes through between the grain boundary of the tungsten and is deposited on the cathode surface, while it passes partially through the grain boundaries of the tungsten, moves simultaneously within the cathode and is deposited on the tip surface 193 of the cathode 19.

As a result, after lamp operation over a long time, thorium (Th) can be reliably supplied with high efficiency to the tip surface 193 of the cathode 19 and stable radiant light is obtained over a long time.

If a carbide layer is applied as far as the tip-side region 196 of the cathode 19, the tip-side region 196 reaches roughly 2900° C., melting the tungsten carbide ($W_2C$). This results in the disadvantages of premature wear of the cathode tip, and thus, shortening of the service life and the danger of blackening of the arc tube resulting in premature reduction of the intensity of the radiant light. Therefore, the tip-shaped region 196 of the cathode 19 is no longer provided with a carbide layer.

The thorium feed phenomenon also optimally occurs at a temperature of the carbide layer of 1400° C. to 1800° C. of the carbide layer. A cathode has been suggested in which, as shown in FIG. 10, on the cathode surface, a surface 197 perpendicular to the axis L is formed and is irradiated with light from the arc so that the carbide layer applied to the cathode reliably reaches 1400° C. to 1800° C., and in which, thus, the carbide layer A which has formed on the vertical surface 197 is reliably fixed at the range from 1400° C. to 1800° C. so that the thorium feed phenomenon can be carried out even more flexibly. This technology is described in Japanese Application Publication JP-A 2005-142071 (U.S. Patent Application Publication 2005/0099121 A1). FIG. 10 is a top view of the cathode in which the carbide layer A is advantageously shown using broken lines.

Recently, however, in the field of projector apparatus using DLP® technology, a discharge lamp with an increased amount of xenon gas added, an increased operating pressure of the lamp and a simultaneously reduced distance between the electrodes has been developed, since there is more and more a demand for a point light source lamp with high radiance.

However, in this discharge lamp, there is a tendency for the cathode temperature to increase due to the effect of the radiant heat of the anode, since the anode temperature is higher than in the past. As a result, the thorium (Th) contained in the cathode is prematurely reduced and dried out in a short time. Furthermore, since the tip area of the cathode is shifted into a high-temperature state, the crystal grain size of the tip area of the cathode increases. The movement of the thorium (Th) in the cathode is prevented by the crystal grains. The thorium (Th) is no longer supplied to the cathode tip.

This means that thorium (Th) can no longer be supplied to the cathode tip after lamp operation, resulting in the disadvantages that the flicker phenomenon occurs and images on the screen flicker.

SUMMARY OF THE INVENTION

The invention was devised to eliminate the above described disadvantages in the prior art. Thus, a primary object of the invention is to devise a high pressure discharge lamp with a long service life in which, after lamp operation over a long time, thorium (Th) can be stably supplied to the cathode tip, and in which formation of the flicker phenomenon is suppressed over a long time.

According to a first aspect of the invention, in a high pressure discharge lamp in which there are an anode and a cathode opposite each other in the bulb, this object is achieved in that the above described cathode is made of tungsten which contains thorium oxide, that on its surface, apart from the tip end, a carbide layer of tungsten carbide is formed, and that the above described cathode is bordered by an emitter containing body of tungsten which contains thorium dioxide, for which, at least in one region bordering the cathode, a carbide layer of tungsten carbide is formed.

In a development of the invention, in a high pressure discharge lamp according to a first aspect, the object is achieved especially in that the above described emitter containing body is a solid body, that it is provided with a through opening, and which forms a fit with the cathode, and that it is retained by the cathode.

The object is also achieved by the invention in a high pressure discharge lamp especially in that the above described emitter containing body is a linear body and that it is retained by the cathode being wound around it.

ACTION OF THE INVENTION

The discharge lamp in accordance with the invention supplies thorium (Th) as the emissive material from the emitter containing body which is retained by the cathode to the cathode surface so that over a long time thorium (Th) can be stably supplied to the cathode tip. Thus, a discharge lamp with a long service life is obtained in which formation of the flicker phenomenon over a long time is suppressed.

The invention is further described below with reference to the accompanying drawings.

DETAILED DESCRIPTION OF THE INVENTION

Figure 8:
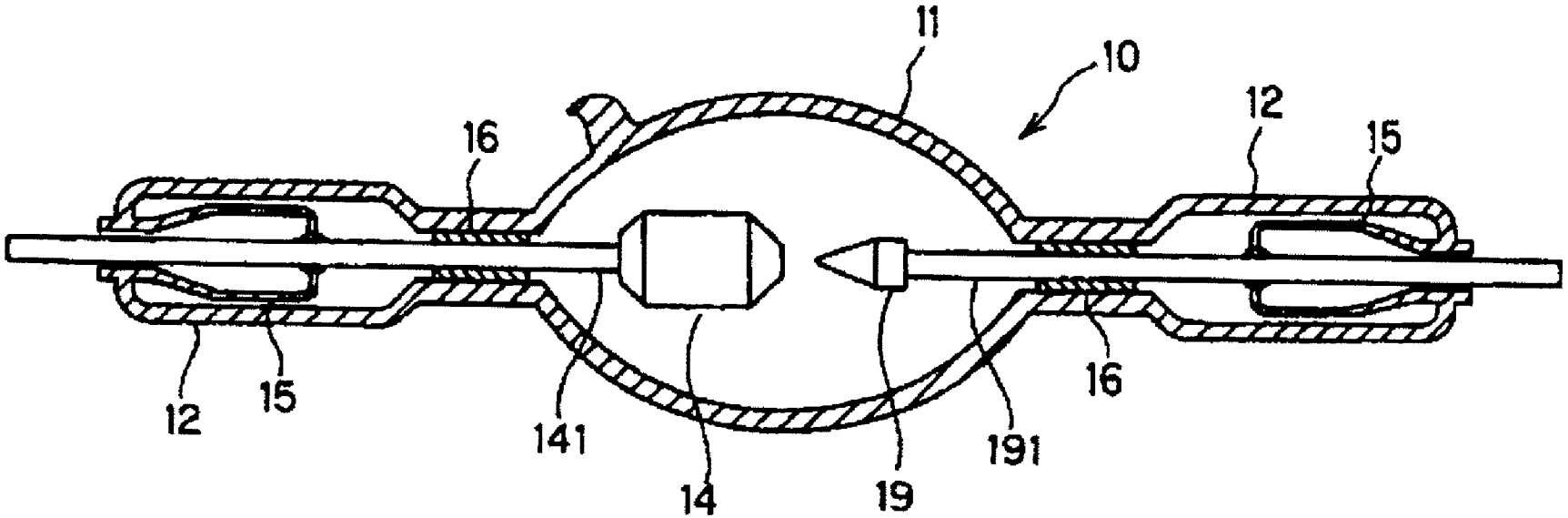
Fig. 8 (Prior Art)
FIG. 8 is a schematic cross-sectional view of a conventional high pressure discharge lamp.

The high pressure discharge lamp 10 in accordance with the invention is described below using FIG. 1. For comparison purposes, parts of lamp 10 which correspond to like parts of the conventional lamp of FIG. 8 are identified by the same reference characters.

The high pressure discharge lamp 10 comprises a silica glass bulb which has an arc tube 11 and sealing parts 12. Furthermore, a cathode 13 and an anode 14 are arranged opposite each other in the arc tube 11.

The cathode 13 and the anode 14 are supported by tungsten electrode rods 131, 141, respectively, which are inserted into a silica glass cylindrical retaining body 16 which has a through opening which extends in a sealing part 12 in the axial direction. Furthermore, the electrode rods 131, 141, are sealed in the sealing part 12 by graded glass 15. The electrode rods 131, 141 extend outward from the outer end of the bulb and also act as outer lead pins which supply power to the cathode 13 and the anode 14. The arc tube 11 is filled with xenon gas.

For the cathode 13, thoriated tungsten is used in which an emissive material of thorium dioxide ($ThO_2$) is doped. It is a sintered electrode of 98% tungsten (W) and 2% thorium dioxide ($ThO_2$). The anode 14 is made of tungsten which does not contain thorium dioxide ($ThO_2$).

Figure 2:
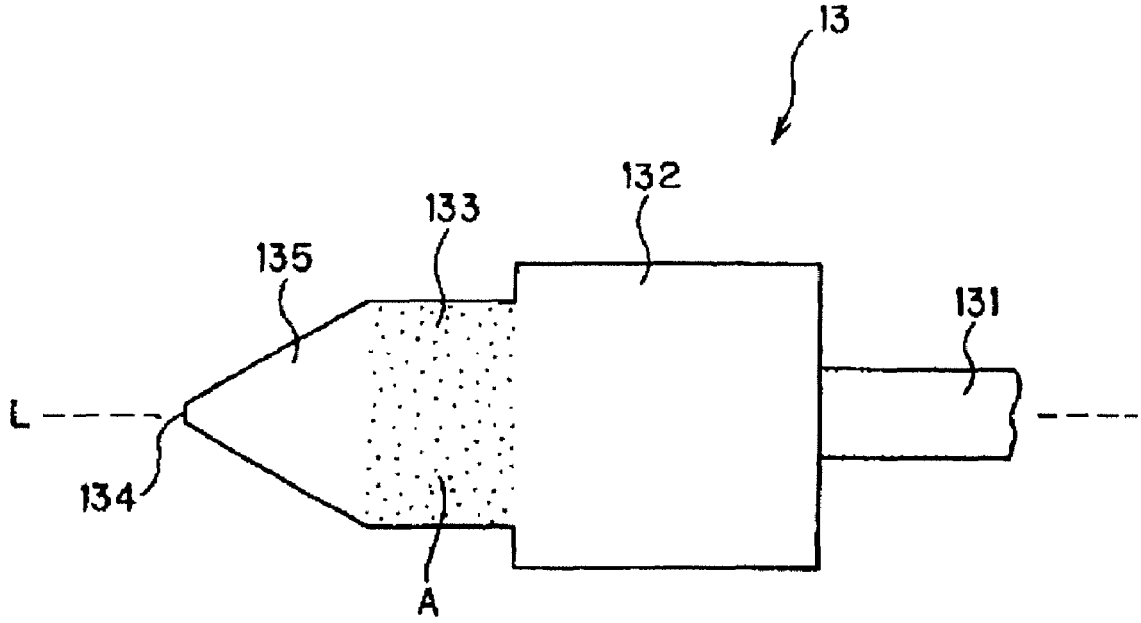
FIG. 2 is a schematic depiction of the cathode of a high pressure discharge lamp in accordance with the invention.

FIG. 2 is an enlarged top view of the cathode 13. The cathode 13 has a cylindrical body part 132, a reduced-diameter cylindrical body part 133, which is formed in one piece on the electrode tip-side end of the body part 132, and of a truncated cone-shaped conical part 135 with a diameter which gradually decreases along the electrode axis L toward the electrode tip (to the left in FIG. 2), and a round flat tip surface 134 is formed on its tip which constitutes the tip end facing the anode.

On the surface of the reduced diameter body part 133 of the cathode 13, a carbide layer A of tungsten carbide ($W_2C$) is formed. This carbide layer A is obtained by a dispersion liquid of a carbon powder being applied to the surface of the reduced diameter body part 133 and being heat treated in a vacuum. As a result, this carbide layer A is present not only on the surface of the reduced diameter body part 133, but is also cemented from the surface up to roughly 100 μm to the inside and is located there.

Figure 3:
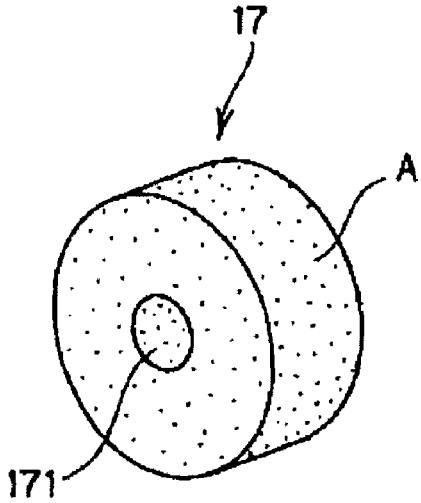
FIG. 3 is a schematic perspective view of the support body for emissive material which is held fast by the cathode in a high pressure discharge lamp in accordance with the invention.

FIG. 3 is a perspective view in which only the emitter containing body 17 is shown. The emitter containing body 17 is a disk-like, solid body with a through opening 171 in its middle. Like the cathode 13 it is made of thoriated tungsten in which an emissive material of thorium dioxide ($ThO_2$) is doped. It is a sinter body of 98% tungsten (W) and 2% thorium dioxide ($ThO_2$). On the entire surface, including the inner surface of the through opening 171 of the emitter containing body 17, a carbide layer A of tungsten carbide ($W_2C$) is formed, and like the carbide layer of the cathode, is obtained by a dispersion liquid of carbon powder being applied to the surface of the emitter containing body and being heat treated in a vacuum. As a result, this carbide layer A is present not only on the inside surface of the through opening 171, but is also produced so as to extend inward from the surface to roughly 100 μm below the surface.

Figure 4:
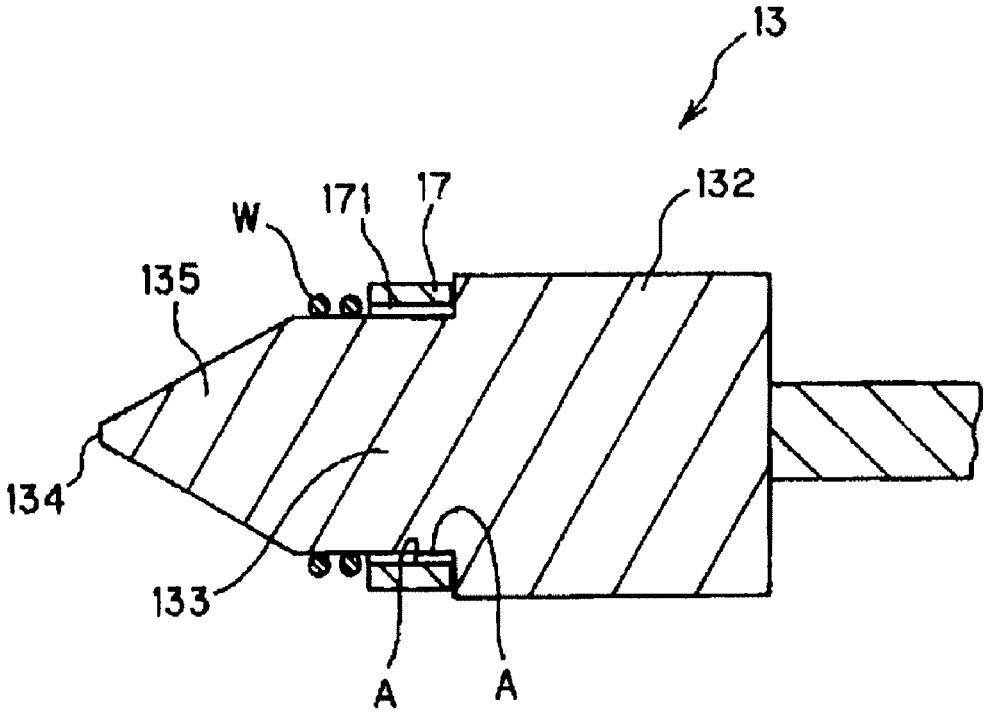
FIG. 4 is a schematic cross-sectional view of the cathode of a high pressure discharge lamp in accordance with the invention which retains the emitter containing body.

FIG. 4 shows a cross section in which an emitter containing body is applied to the cathode. The reduced diameter body part 133 of the cathode 13 forms a fit with the through opening 171 of the emitter containing body 17, by which the emitter containing body 17 is fixed on the cathode 13. The outer peripheral surface of the reduced diameter body part 133 of the cathode 13 in which the carbide layer A is formed, and the inner peripheral surface of the through opening 171 of the body 17 for the emissive material in which the carbide layer A is formed, border one another.

The region in which the emitter containing body 17 borders the cathode 13 is therefore the inner peripheral surface of the through opening 171 of the emitter containing body 17.

In FIG. 4, the gap between the inner peripheral surface of the through opening 171 of the emitter containing body 17 and the reduced diameter body part 133 is shown exaggerated. The inner peripheral surface of the through opening 171 of the emitter containing body 17, however, in fact, borders the outer peripheral surface of the reduced diameter body part 133.

The reduced diameter body part 133 is, if necessary, wound proceeding from the emitter containing body 17 toward the anode side with a wire formed of a metal with a high melting point, for example, a molybdenum wire W, and the wire is thus attached to prevent the emitter containing body 17 from falling off of the reduced diameter body part 133 of the cathode 13.

Figure 5:
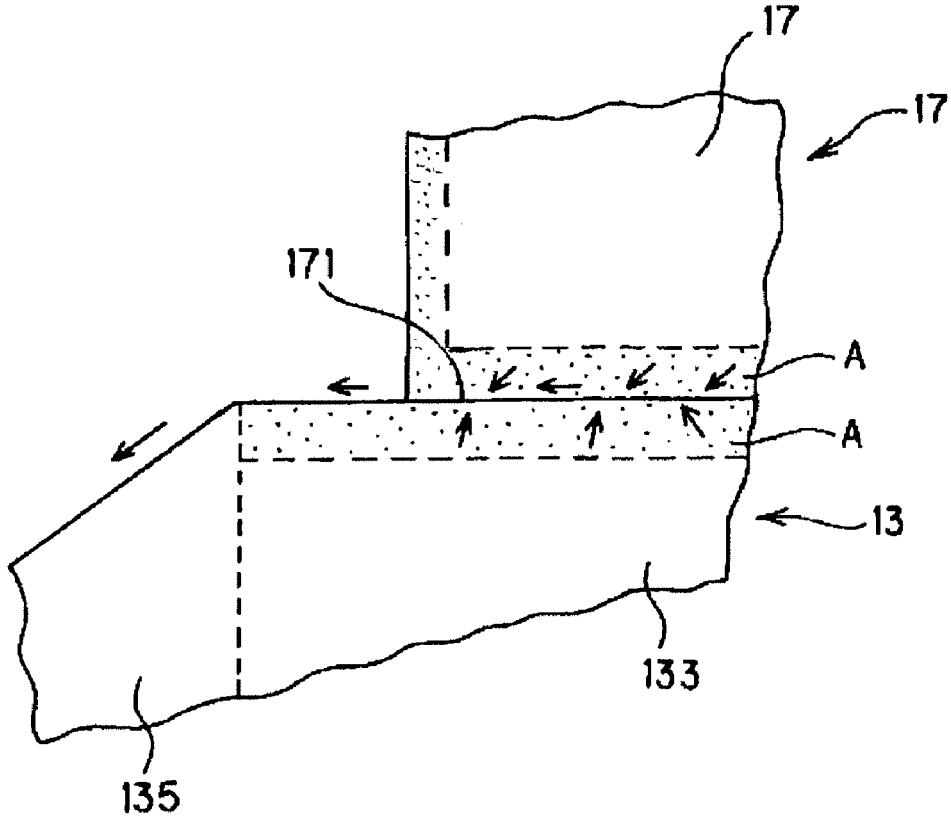
FIG. 5 illustrates the motion of the thorium (Th) in the cathode in a high pressure discharge lamp in accordance with the invention.

FIG. 5 schematically illustrates the movement of the thorium (Th) in the cathode of the high pressure discharge lamp in accordance with the invention by the arrows. In the reduced diameter body part 133 of the cathode 13, a carbide layer A is formed. Carbon is located on the surface of the reduced diameter body part 133 and proceeding therefrom, up to roughly 100 μm below the surface. If, during lamp operation, the temperature of the reduced diameter body part 133 reaches 1400° C. to 1800° C., as is shown using the above described formulas 1 and 2, by the trapping of the oxygen of the thorium dioxide ($ThO_2$) by tungsten carbide ($W_2C$), thorium (Th) is produced.

The thorium (Th) produced on the surface of the cathode 13 and within the cathode 13 passes through, by grain boundary diffusion, between the grain boundaries of the tungsten and is deposited on the surface of the cathode 13. Due to the high temperature of the tip region of the cathode, surface diffusion takes place. This means that thorium moves along the surface of the reduced diameter body part 133, and also, along the surface of the cone part 135 and is supplied to the tip surface 134 of the cathode 13.

Furthermore, part of the thorium (Th) which has been produced within the cathode 13 moves within the cathode 13 by it passing through between the grain boundaries of the tungsten and is supplied to the tip surface of the cathode 13.

The surface of the emitter containing body 17 and the interior thereof proceeding from the surface up to 100 μm which is an adjacent region in which the cathode 13 borders the emitter containing body 17, due to the heat of the cathode, has essentially the same temperature as the cathode, i.e. 1400° C. to 1800° C.

As a result, in the emitter containing body 17 a carbide layer A is formed. By trapping the oxygen of the thorium dioxide ($ThO_2$) by carbon which is present on the inner surface of the through opening 171 and in the interior proceeding from the inner surface up to a depth of roughly 100 μm in which the emitter containing body 17 borders the cathode 13, thorium (Th) is also produced in the emitter containing body 17.

The thorium (Th) which has been deposited on the inner surface of the through opening 171 of the emitter containing body 17 is supplied to the surface of the reduced diameter body part 133 of the cathode 13, moves on the surface of the reduced diameter body part 133 and along the surface of the conical part 135 so that it is supplied to the tip surface of the cathode 13.

As a result, thorium (Th) is supplied to the cathode 13 from the emitter containing body 17. After lamp operation has commenced, thus over a long time, thorium (Th) can be stably supplied to the cathode tip. Thus, the formation of the flicker phenomenon can be suppressed as a result of drying out of thorium (Th) atoms over a long time.

Furthermore, after operation, the tip of the cathode 13 reaches a high temperature so that the grain size of the tip of the cathode 13 increases. Therefore, the thorium (Th) is also supplied from the emitter containing body 17 to the surface of the cathode 13 when it becomes impossible for the thorium (Th) produced within the cathode 13 to pass between the grain boundaries and move within the cathode. Thus, thorium (Th) can be reliably, and moreover, stably supplied to the tip surface 134 of the cathode 13, and after lamp operation has commenced, thorium (Th) can be stably supplied to the cathode tip over a long time. Thus, the formation of the flicker phenomenon can be suppressed over a long time.

Figure 6:
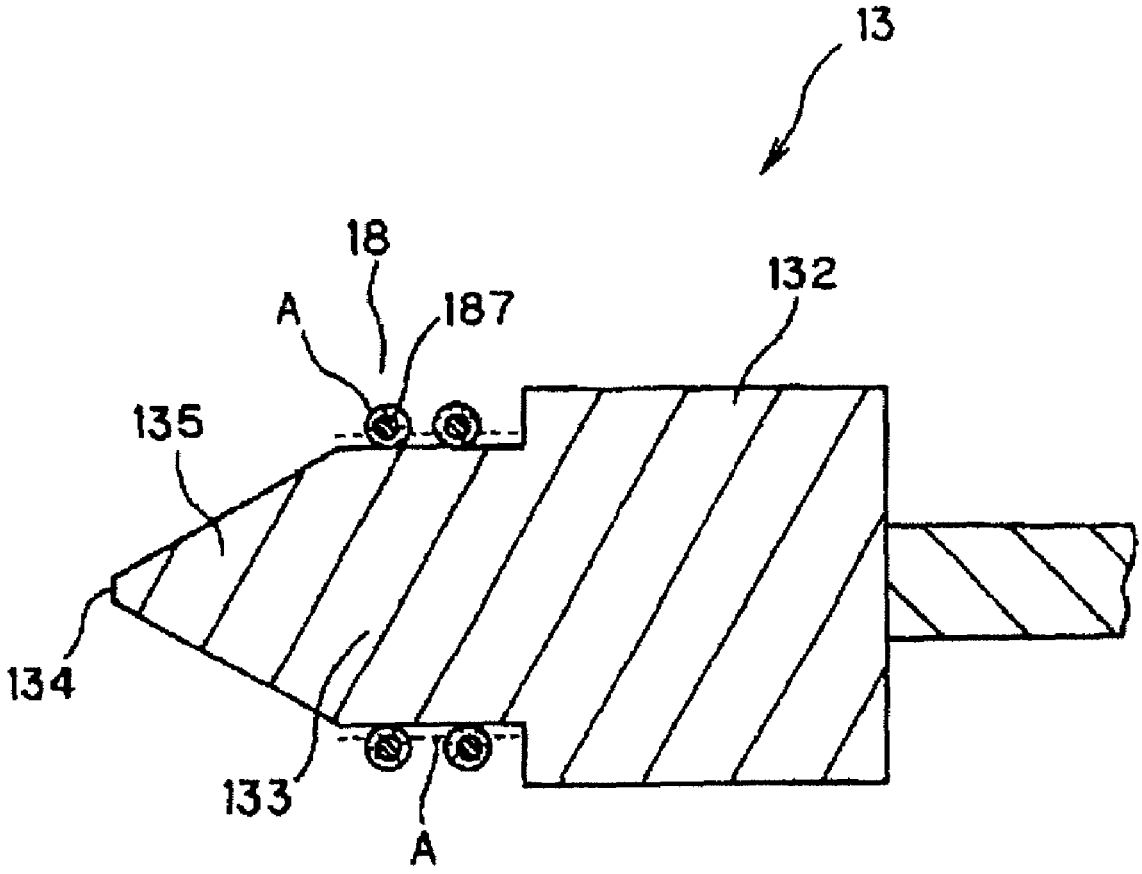
FIG. 6 is a schematic cross-sectional view of the cathode of a high pressure discharge lamp in accordance with the invention which retains another emitter containing body.

FIG. 6 shows a schematic of another example in which an emitter containing body 18 is attached to the cathode, which body is a linear body with a diameter from 6 mm to 12 mm, which is a wire of thoriated tungsten, in which the emissive material of thorium dioxide ($ThO_2$) is doped and which is made of 98% tungsten (W) and 2% thorium dioxide ($ThO_2$).

On the surface of the linear body 18 for the emitter containing body, a carbide layer A of tungsten carbide ($W_2C$) is formed which is obtained by a dispersion liquid of a carbon powder being applied to the surface of the emitter containing body 18 and being heat treated in a vacuum. In FIG. 6, the dimensions of the carbide layer A of the emitter containing body 18 are shown exaggerated. The carbide layer A of the reduced diameter body part 133 is advantageously shown using broken lines.

This emitter containing body 18 in the state in which the carbide layer A is formed beforehand on the surface is wound tightly around the reduced diameter body part 133 of the cathode 13 in which the carbide layer A is formed and is thus retained by the cathode 13.

On this cathode 13, a carbide layer A is formed on the reduced diameter body part 133 of the cathode 13. On the surface of the reduced diameter body part 133 and within it there is carbon proceeding from the surface down to a depth of 100 μm.

If, during lamp operation, the temperature of the reduced diameter body part 133 reaches 1400° C. to 1800° C., as is shown using the above described formulas 1 and 2, by the trapping of the oxygen of the thorium dioxide ($ThO_2$) by tungsten carbide ($W_2C$), thorium (Th) is produced.

The thorium (Th) produced on the surface of and within the cathode 13 passes through by grain boundary diffusion between the grain boundaries of the tungsten and is deposited on the surface of the cathode 13. Due to the high temperature of the tip region of the cathode, surface diffusion takes place. This means that thorium moves along the surface of the reduced diameter body part 133 and along the surface of the conical part 135 and is supplied to the tip surface 134 of the cathode 13.

Furthermore, part of the thorium (Th) which has been produced within the cathode 13 moves within the cathode 13 by it passing through between the grain boundaries of the tungsten and is supplied to the tip surface of the cathode 13.

The emitter containing body 18, due to the heat of the cathode, has essentially the same temperature as the cathode, i.e. 1400° C. to 1800° C.

As a result, in the emitter containing body 18, by trapping the oxygen of the thorium dioxide ($ThO_2$) by carbon which is present on the surface and in the interior proceeding from the inner surface down to a depth of roughly 100 μm, in which the emitter containing body 18 borders the carbon 13, thorium (Th) is also produced.

The thorium (Th) which has been deposited on surface of the emitter containing body 18 is supplied to the surface of the reduced diameter body part 133 of the cathode 13, moves on the surface of the reduced diameter body part 133 and also along the surface of the conical part 135 and is supplied to the tip surface 134 of the cathode 13.

As a result, thorium (Th) is also supplied to the cathode 13 from the emitter containing body 18. After lamp operation over a long time thorium (Th) can thus be stably supplied to the cathode tip. Thus, formation of the flicker phenomenon as a result of drying out of thorium (Th) atoms over a long time can be suppressed.

A high pressure discharge lamp filled with xenon as the emitter was described above. However, the invention can also be applied to a high pressure discharge lamp in which the emitter is mercury.

Figure 1:
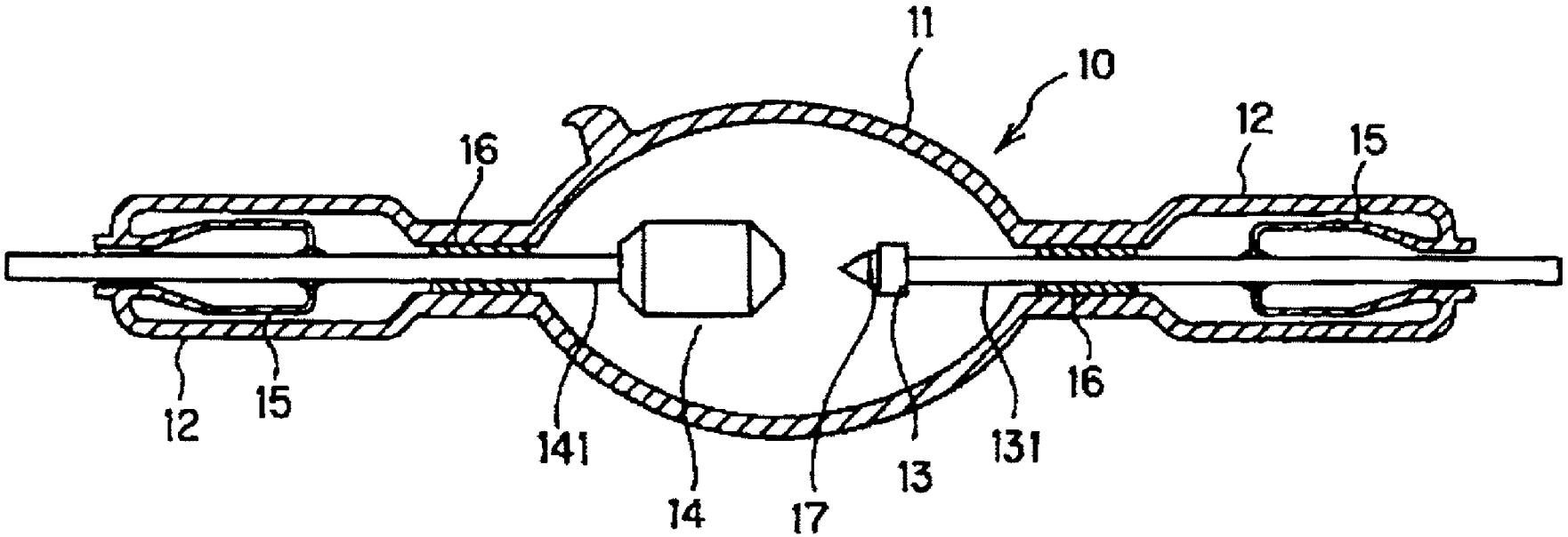
FIG. 1 is a schematic cross-sectional view of a high pressure discharge lamp in accordance with the invention.

Next, a test was run in which using the high pressure discharge lamp in which the cathode shown in FIG. 1 and FIG. 4 with an emitter containing body was used, the situation for formation of flicker was studied.

If the amplitude of the voltage during operation exceeds 1 V, flickering of the images on the screen becomes apparent. At the instant at which the voltage amplitude exceeds 1 V, therefore, flickering of the images on the screen is regarded as disadvantageous. This instant was therefore defined as lamp service life by flickering.

Figure 7:
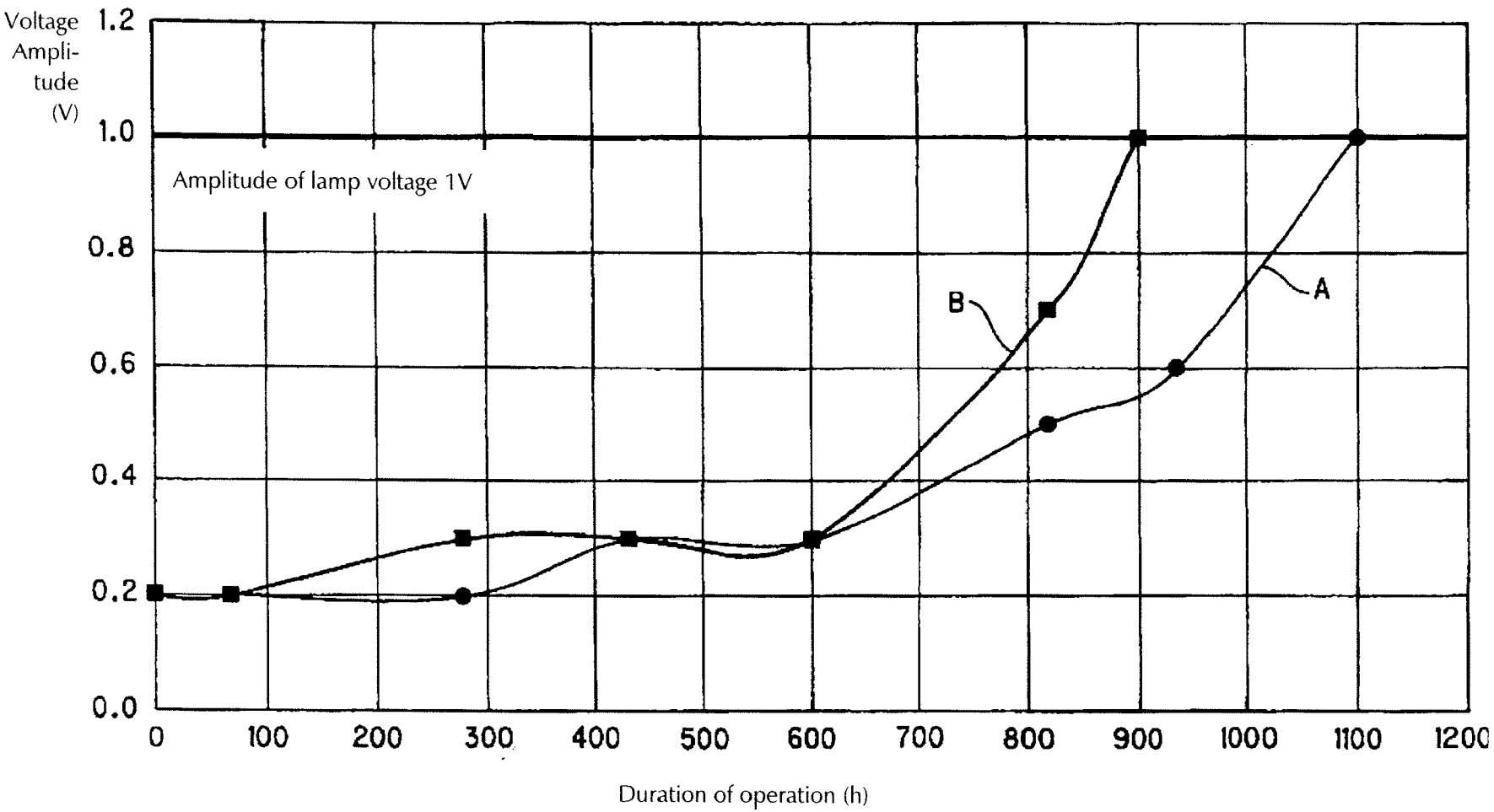
FIG. 7 is a plot of the data of test results in which the situation of flicker formation was studied.
Figure 9:
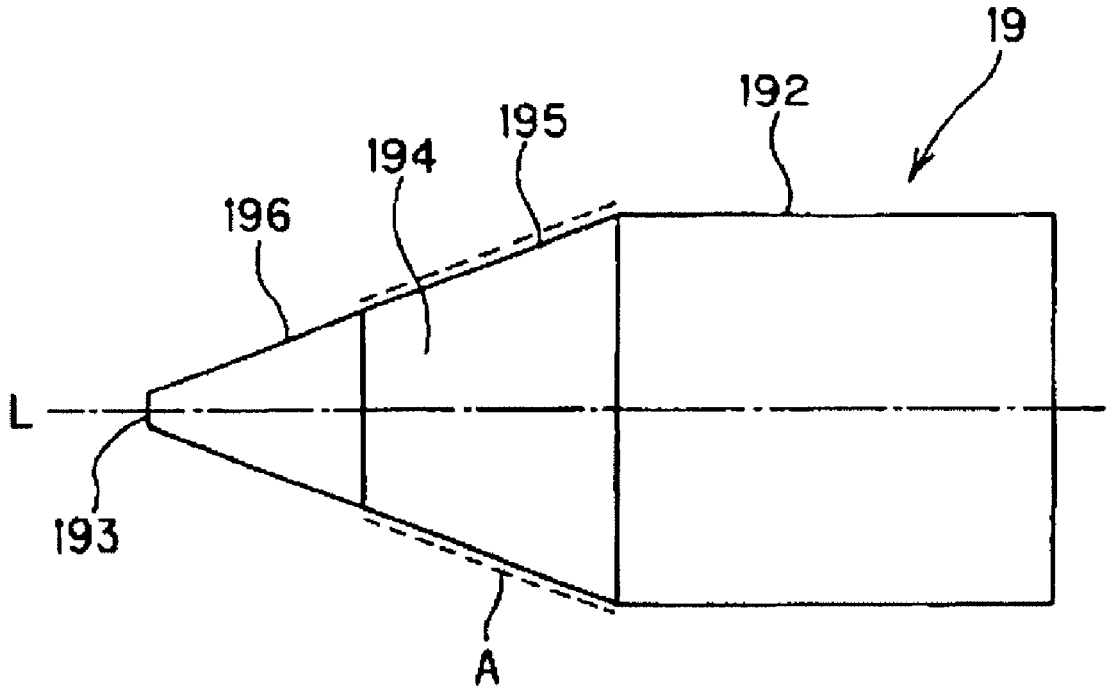
Fig. 9 (Prior Art)
FIG. 9 is an enlarged view of the cathode of a conventional high pressure discharge lamp.
Figure 10:
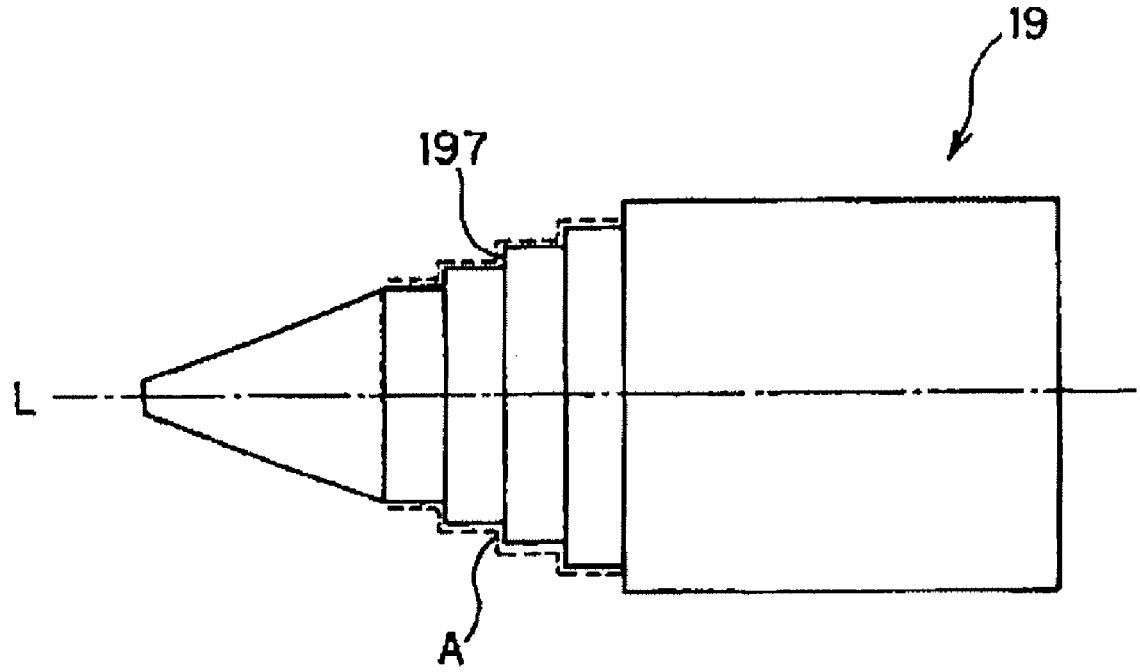
Fig. 10 (Prior Art)
FIG. 10 is an enlarged view of cathode of another conventional high pressure discharge lamp.

The high pressure discharge lamp which was used for this test is operated with rated values of 24 V, 78 A and 2 kW. The comparison lamp was a lamp with the same specifications except for using the cathode shown in FIG. 9 without the emitter containing body for the test. FIG. 7 shows the results.

In FIG. 7, the x-axis plots the duration of operation in hours and the y-axis plots the amplitude of the voltage (V). The curve A shows the data of the high pressure discharge lamp in accordance with the invention and the curve B shows the data of the comparison lamp. As FIG. 7 shows, in the comparison lamp, the voltage amplitude 900 hours after operation commenced is greater than or equal to 1 V, where flickering of the images on the screen has become apparent and thus the service life of the lamp is reached.

On the other hand, in the high pressure discharge lamp in accordance with the invention, the voltage amplitude does not become greater than or equal to 1 V until 1100 hours after operation, where flickering of images on the screen has become apparent and thus the service life of the lamp is reached. Therefore, the end of the lamp service life as a result of flickering was increased by 200 hours.

From this result, it becomes apparent that, for the high pressure discharge lamp in accordance with the invention, after lamp operation over a long time, thorium (Th) is stably supplied to the cathode tip and that thus a lamp with a long service life is obtained in which formation of the flicker phenomenon is suppressed over a long time.

What we claim is:

1. High pressure discharge lamp, comprising:

a bulb in which an anode and a cathode are disposed opposite each other, the cathode being formed of tungsten which contains thorium oxide, and a carbide layer of tungsten carbide being formed on an outer surface of the cathode away from a tip end of the cathode, an emitter containing body of tungsten which contains thorium dioxide bordering with at least a partial region the outer surface of the cathode, and a carbide layer of tungsten carbide formed in said partial region bordering the cathode.

2. High pressure discharge lamp in accordance with claim 1, wherein the emitter containing body is a solid body provided with a through opening, and wherein the cathode forms a fit within said through opening by which the emitter containing body is held fast on the cathode.

3. High pressure discharge lamp in accordance with claim 1, wherein the emitter containing body is a linear body with which the cathode is wound at least in regions.

4. High pressure discharge lamp in accordance with claim 1, wherein the cathode has a tip region, a first body part and a second body part, the second body part being located between the first body part and the tip region and having a smaller diameter than the first body part.

5. High pressure discharge lamp in accordance with claim 4, wherein the emitter containing body is located on the outer surface of the second body part.

* * * * *